US007092648B2

(12) United States Patent
Choi

(10) Patent No.: US 7,092,648 B2
(45) Date of Patent: Aug. 15, 2006

(54) METHOD OF CONTROLLING AN AMOUNT OF TONER CHARGING IN AN ELECTROPHOTOGRAPHIC IMAGE FORMING APPARATUS AND APPARATUS USING THE SAME

(75) Inventor: Jeong-jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 177 days.

(21) Appl. No.: 10/834,102

(22) Filed: Apr. 29, 2004

(65) Prior Publication Data

US 2004/0218937 A1 Nov. 4, 2004

(30) Foreign Application Priority Data

May 2, 2003 (KR) ..... 10-2003-0028171

(51) Int. Cl.
*G03G 15/08* (2006.01)
*G03G 15/09* (2006.01)

(52) U.S. Cl. ..... 399/27; 399/58; 399/258; 430/120

(58) Field of Classification Search ..... 399/27, 399/58, 53, 61, 62, 258; 430/120, 122
See application file for complete search history.

(56) References Cited

U.S. PATENT DOCUMENTS 6,006,050 A * 12/1999 Watanabe et al. ..... 399/58
6,049,685 A * 4/2000 Murakami et al. ..... 399/263
6,687,467 B1 * 2/2004 Katoh ..... 399/27 X

FOREIGN PATENT DOCUMENTS

JP 4121766 4/1992
JP 6289716 10/1994
JP 08-262861 10/1996

* cited by examiner

*Primary Examiner*—Sophia S. Chen
(74) *Attorney, Agent, or Firm*—Roylance, Abrams, Berdo & Goodman, LLP

(57) ABSTRACT

A method of controlling an amount of toner charging in an electrophotographic image forming apparatus using a two-component developing agent, and an apparatus using the method. The method includes counting an agitation time when a toner and a carrier are mixed and are agitated in an agitation region of a developing unit, and if the agitation time reaches a predetermined reference agitation time, supplying a predetermined amount of new toner to the agitation region to prevent overcharging of the toner.

20 Claims, 4 Drawing Sheets

METHOD OF CONTROLLING AN AMOUNT OF TONER CHARGING IN AN ELECTROPHOTOGRAPHIC IMAGE FORMING APPARATUS AND APPARATUS USING THE SAME

BACKGROUND OF THE INVENTION

This application claims priority from Korean Patent Application No. 2003-28171, filed on May 2, 2003, in the Korean Intellectual Property Office, the disclosure of which is incorporated herein in its entirety by reference.

1. Field of the invention

The present invention relates to an electrophotographic image forming apparatus. More particularly, the present invention relates to a method of controlling an amount of toner charging in an electrophotographic image forming apparatus using a two-component developing agent.

2. Description of the Related Art

In general, an electrophotographic image forming apparatus is a device which develops an electrostatic latent image formed on a photosensitive body using a developing agent, forms a toner image, and then, transfers and fuses the toner image onto a recording medium, thereby printing an image.

A two-component developing agent typically comprises toner representing a predetermined color, and a carrier for transferring toner from a developing unit to the photosensitive body More specifically, in case of a nonmagnetic two-component developing agent, the toner is charged, attached to the carrier due to an electrostatic force, and transferred to the photosensitive body. The toner is mixed with the carrier and agitated in the developing unit, and then charged due to friction with the carrier.

Parameters that affect the amount of toner charging include the ratio of the carrier and the toner, an agitation time, and the amount of developing agent. As the speed of the electrophotographic image forming apparatus increases, the agitation time has a greater affect on the amount of toner charging.

In particular, when an image having a low concentration of imaging, such as about 1–2% or a substantially white image is printed, the amount of toner developed on the photosensitive body is small. Thus, new toner is not supplied to an agitation region in which the toner and the carrier are agitated. If the toner is continuously agitated with the carrier in this state, the toner becomes overcharged. As a result, an attaching force between the toner and the carrier becomes excessively large, and the toner is not well developed on the photosensitive body when a next image is printed and the carrier is also developed on the photosensitive body, thereby lowering the concentration of toner on the formed image.

SUMMARY OF THE INVENTION

The present invention provides a method of controlling an amount of toner charging in an electrophotographic image forming apparatus having an improved structure in which an agitation time for a toner is detected in a developing unit in order to control the amount of toner charging.

According to an aspect of the present invention, a method of controlling an amount of toner charging in an electrophotographic image forming apparatus using a two-component developing agent. The method provided comprises (a) counting an agitation time when a toner and a carrier are mixed and are agitated in an agitation region of a developing unit, and if the agitation time reaches a predetermined reference agitation time, supplying a predetermined amount of new toner to the agitation region to prevent overcharging of the toner.

The method may further comprise (b) if the new toner is supplied to the agitation region before the agitation time reaches the reference agitation time, resetting the agitation time and counting the agitation time again. In this case, whether the new toner is supplied to the agitation region may be determined by checking whether a toner supplying motor for supplying toner to the agitation region is driven.

The method may further comprise (c) if the electrophotographic image forming apparatus is turned on, checking whether the developing unit is a new developing unit, and if the developing unit is the new developing unit, not counting the agitation time and agitating the developing agent so that the toner in the agitation region has a predetermined charging amount.

Step (c) may be performed when a printing operation starts or when the electrophotographic image forming apparatus is turned on, and whether the developing unit is a new developing unit may be detected by checking an accumulated printing amount of the developing unit.

A weight ratio of toner with respect to the developing agent in the agitation region may be maintained to be within 1.2 times of a predetermined reference weight ratio. Here, the reference weight ratio may be less than 10%, and the accumulated printing amount of the developing unit may be set in a plurality of steps, and the reference weight ratio may be set separately for each step. In this case, if the printing amount is further increased, the reference weight ratio may be set to be larger.

The method may further comprise (d) comparing the weight ratio of toner with respect to the developing agent in the agitation region with the predetermined reference weight ratio. If the weight ratio of toner is less than the reference weight ratio, further supplying toner to the agitation region, and if the weight ratio of toner is not less than the reference weight ratio, the supply of toner to the agitation region is stopped, and if the weight ratio of toner with respect to the developing agent in the agitation region after step (a) is performed is greater than 1.2 times the reference weight ratio, step (d) is performed.

BRIEF DESCRIPTION OF THE DRAWINGS

The above and other aspects and advantages of the present invention will become more apparent by describing in detail exemplary embodiments thereof with reference to the attached drawings in which.

DETAILED DESCRIPTION OF THE INVENTION

Hereinafter, exemplary embodiments of the present invention will be described in detail with reference to the accompanying drawings.

A method of controlling an amount of toner charging according to the embodiments of the present invention is used in an electrophotographic image forming apparatus using a two-component developing agent in which toner for representing a predetermined color and a carrier for transferring toner to a photosensitive body are mixed. In particular, the method of controlling the amount of toner charging is used in an electrophotographic image forming apparatus using a nonmagnetic developing agent.

Figure 1:
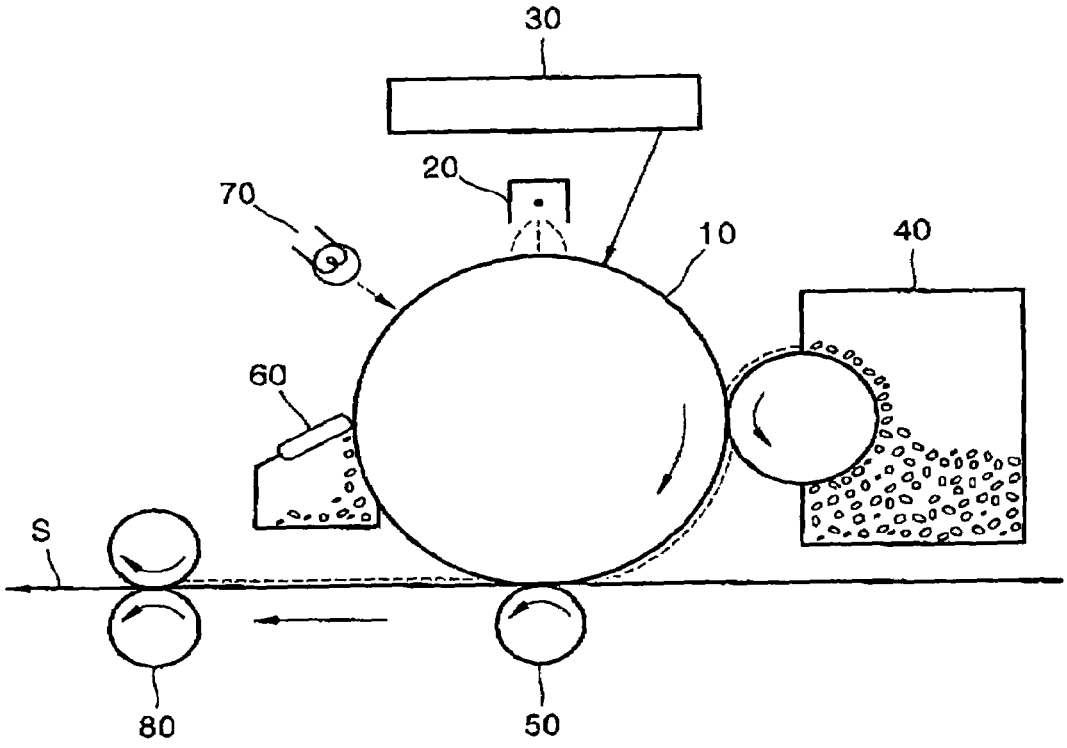
FIG. 1 is a diagram illustrating an example of an electrophotographic image forming apparatus using a method of controlling an amount of toner charging according to an embodiment of the present invention.

FIG. 1 schematically illustrates a structure of an electrophotographic image forming apparatus that uses a method of controlling an amount of toner charging according to an embodiment of the present invention. Referring to FIG. 1, the electrophotographic image forming apparatus includes the photosensitive body 10, a charging unit 20, an exposure unit 30, a developing unit 40, a transfer unit 50, a cleaner 60, an eraser 70, and a fusing unit 80.

The photosensitive body 10 is a member having optical conductivity and may comprise a drum-shape as shown in FIG. 1 or a belt-shape. The charging unit 20 supplies a charge onto the surface of the photosensitive body 10 and charges the photosensitive body 10 to a predetermined potential. A corona charger which is shown in FIG. 1 or a charging roller may be used as the charging unit 20. The exposure unit 30 radiates light corresponding to image information onto the charged photosensitive body 10. As such, an electrostatic latent image is formed on the surface of the photosensitive body 10 due to a potential difference between an area where light is irradiated and an area where light is not irradiated. Typically, a laser scanning unit (LSU) is used as the exposure unit 30. The developing unit 40 supplies toner to the electrostatic latent image formed on the photosensitive body 10, thereby forming a toner image. The transfer unit 50 applies a predetermined potential to the rear side of a sheet of paper S, which is adjacent to or contacts the photosensitive body 10, allowing the toner image formed on the photosensitive body 10 to be transferred onto the sheet of paper S. A transfer roller as shown in FIG. 1 or a corona transfer unit may be used as the transfer unit 50. When the toner image transferred onto the sheet of paper S passes through the fusing unit 80, the toner image is heated, pressurized, and fused onto the sheet of paper S, thereby completing image formation. Reference numerals 60 and 70 respectively denote a cleaner and an eraser, which respectively remove any toner and charge remaining on the surface of the photosensitive body 10 after the toner image is transferred onto the sheet of paper S.

Figure 2:
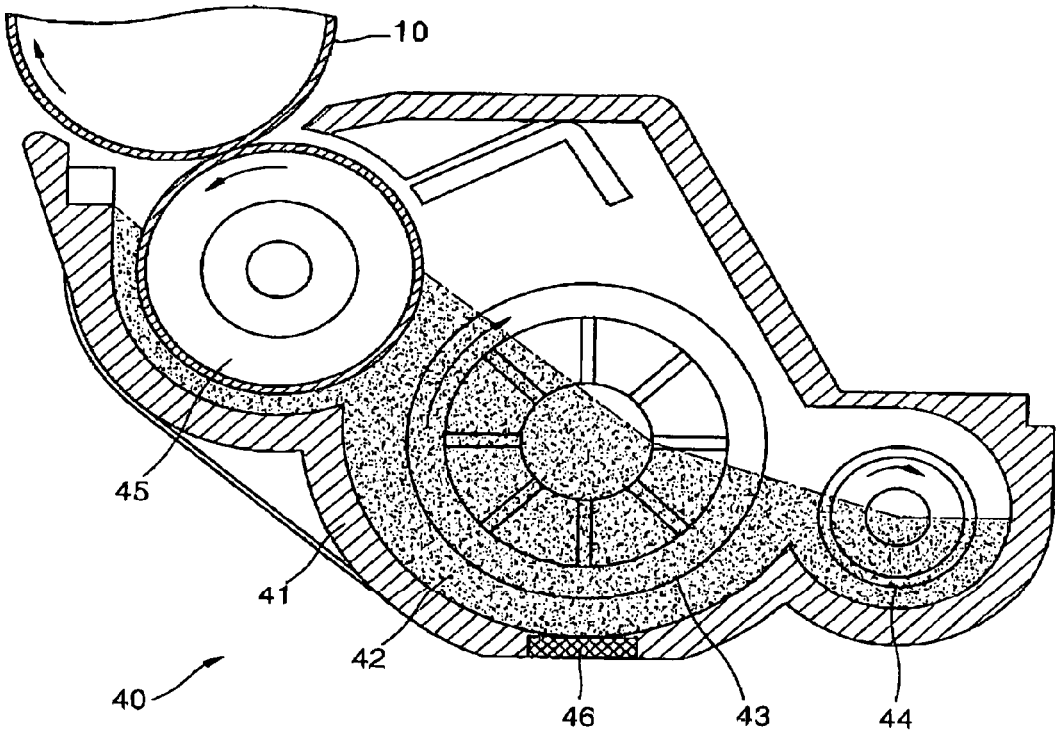
FIG. 2 is a cross-sectional view illustrating an example of a developing unit according to an embodiment of the present invention.

FIG. 2 is a cross-sectional diagram illustrating an example of a developing unit in accordance with an embodiment of the present invention. Referring to FIG. 2, an agitator 43, which agitates the toner and the carrier, is installed in an agitation region 42 inside a housing 41. In addition, a toner supplying roller 44 which supplies the toner from a toner container (not shown) to the agitation region 42 is installed at one side of the housing 41. Reference numeral 45 denotes a developing roller. The developing roller 45 attaches the carrier to which the toner is attached so that the toner is attached to the electrostatic latent image formed on the photosensitive body 10, and supplies the carrier to a developing region (not shown) facing the photosensitive body 10. In addition, in an embodiment of the present invention a detection unit 46 which detects a toner weight ratio of the agitation region 42 can be provided in the developing unit 40.

The agitator 43 is rotated in the agitation region 42 and allows the toner to rub against the carrier, the agitator 43, and the housing 41, thereby friction-charging the toner. The toner is attached to the carrier by friction charge. The agitator 43 may be driven by a driving motor (not shown) which drives the photosensitive body 10 and a paper feeding unit (not shown). In addition, an additional driving motor (not shown) which drives the agitator 43 may be provided in an electrophotographic image forming apparatus or a developing unit. The toner supplying roller 44 may be driven by a toner supplying motor (not shown).

The toner inside the agitation region 42 needs to be maintained at a predetermined charging level to allow optimum developing performance. However, when an image having a low image concentration of about 1–2% or a white image is printed, in particular, when such an image is consecutively printed, the toner inside the agitation region 42 is continuously agitated without supplying significant amounts of new toner, thereby increasing the toner charging level. Since an attaching force between the toner and the carrier becomes stronger, the amount of toner developed into the electrostatic latent image formed on the photosensitive body 10 is rapidly reduced. As such, the image concentration may be lowered instantaneously. In addition, the carrier may also be developed on the photosensitive body 10, and the photosensitive body 10 may be damaged.

The method of controlling a toner charging amount according to an embodiment of the present invention prevents toner overcharging. When the concentration of the toner with respect to the developing agent in the agitation region 42 exceeds 10%, the amount of toner is sufficiently increased, and overcharging of the toner does not occur. Thus, preferably, the method of controlling the amount of toner charging according to an embodiment of the present invention is used in an electrophotographic image forming apparatus having toner concentration of less than 10% with respect to the developing agent. The 10% value is a weight ratio of toner with respect to the developing agent, and is computed by T/(T+C) wherein T denotes the amount of toner and C denotes the amount of carrier.

The method of controlling the amount of toner charging according to an embodiment of the present invention counts an agitation time Ta so as to detect overcharging of the toner when an image is printed. If the agitation time Ta reaches a predetermined reference agitation time Tr, it is determined that the toner is overcharged, and a predetermined amount of new toner is supplied to the agitation region 42. Further, the weight ratio Wt of toner with respect to the developing agent in the developing unit (agitation region) is detected, thereby controlling the toner concentration so that the toner concentration in the developing unit (agitation region) does not increase over a predetermined level.

Figure 3:
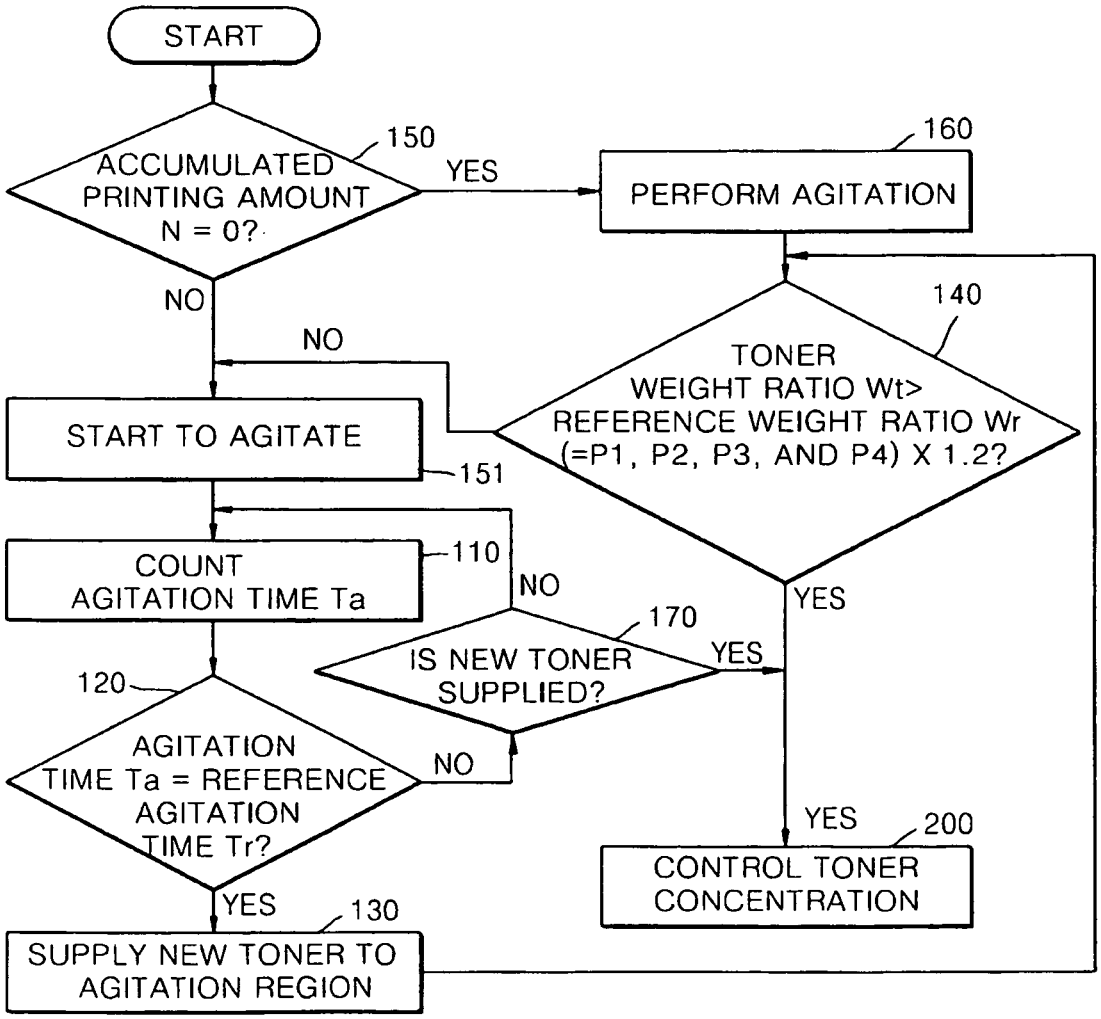
FIG. 3 is a flowchart illustrating a method of controlling a toner charging amount according to an embodiment of the present invention.

FIG. 3 is a flowchart illustrating a method of controlling the amount of toner charging according to an embodiment of the present invention. Referring to FIG. 3, if a printing start instruction to print an image is input an accumulated printing amount is determined in step 150, and if the accumulated print amount is not equal to zero, the agitator 43 is rotated and starts to agitate the toner and the carrier in step 151. In this case, in order to indirectly detect the amount of toner charging, an agitation time Ta is counted in step 110. As described above, the agitator 43 may be driven by a driving motor (not shown) which drives the photosensitive body 10 and the paper feeding unit, or by an additional driving motor (not shown) for driving an agitator. Thus, the agitation time Ta can be known by counting a driving time of one of the driving motors.

If the agitation time Ta reaches a predetermined reference time Tr in step 120, it is determined that the toner is overcharged, and a toner supplying roller is driven, thereby supplying new and uncharged toner to the agitation region 42 in step 130. In this case, the toner in the agitation region 42 may be substantially overcharged. The reference agitation time Tr may be determined by measuring a time until the charging amount of toner exceeds a preferable charging amount, through repetitive experiments in consideration of the number of revolutions of the agitator 43 according to a driving time of the driving motor (not shown) and the physical property of the toner and the carrier.

The new toner in step 130 is supplied for a predetermined amount of time. In other words, the driving time of a toner supplying motor (not shown) is preset, and if the agitation time Ta reaches the reference agitation time Tr, the toner supplying motor is driven for the predetermined amount of time, and a predetermined amount of new toner is supplied to the agitation region 42. In this case, a supplying amount of new toner is properly selected through repetitive experiments so that the new toner is mixed with the overcharged toner, and the toner in the agitation region 42 has a preferable charge amount. The driving time of the toner supplying motor is determined according to the amount of new toner supplied.

As described above, when the new toner is supplied based on the reference agitation time Tr, a toner amount in the agitation region 42 is continuously increased. In other words, the amount of toner developed to the electrostatic latent image is varied according to the image concentration. When an image having low concentration is continuously printed, the amount of toner used in printing is smaller than the amount of toner supplied to the agitation region 42. Thus, the amount of toner in the agitation region 42 is continuously increased.

The amount of toner in the agitation region 42 needs to be limited, because the toner may be dispersed onto the image forming apparatus, and the concentration of the printed image may be excessively increased. Thus, the method of controlling a toner charging amount according to an embodiment of the present embodiment may further comprise the step of controlling the amount of toner in the agitation region 42 below a predetermined level. As an example, the toner amount is indicated by a weight ratio of toner with respect to the above-described developing agent.

To this end, in step 140, a weight ratio Wt of toner in the agitation region 42 is detected and is compared with a predetermined reference weight ratio Wr. If the weight ratio Wt of toner is less than 1.2 times (120%) of the reference weight ratio Wr, the agitation time Tr is reset, and step 110 is performed again. If the weight ratio Wr of toner is greater than 1.2 times of the reference weight ratio Wr, when the reference weight ratio Wr is 5%, if the weight ratio Wt of detected toner is greater than 6%, the method proceeds to step of controlling toner concentration at step 200. This will be described in further detail below with reference to FIG. 4. In this manner, steps 110, 120, and 130 of controlling the amount of toner charging are performed only when the weight ratio Wt of toner in the agitation region 42 is within 1.2 times of the reference weight ratio Wr, and the toner amount in the agitation region 42 is prevented from increasing excessively.

In the present example, a the reference weight ratio Wt is 5% has been described, but of course it will be readily understood that the reference weight ratio Wt may be varied according to an accumulated printing amount N. Preferably, the weight ratio Wt does not exceed 10%. Also, first through fourth weight ratios Wr (=P1, P2, P3, and P4) which will be described later according to the accumulated printing amount N are selectively used as the reference weight ratio Wt.

In addition, when the printing start instruction is input or the electrophotographic image forming apparatus is turned on, an embodiment of the present embodiment preferably further comprises the step of checking whether the developing unit 40 is a new developing unit (step 150). Whether the developing unit 40 is a new developing unit can be known by checking the accumulated printing amount N, which is an accumulated printing amount after the developing unit 40 has been replaced. The accumulated printing amount N may be the number of printed images or the number of printed pixels. The accumulated printing amount N (the number of images or the number of pixels) may be stored in ROM installed in the developing unit 40, for example. When the accumulated printing amount N is "0", it is determined that a new developing unit has been installed.

In case of the new developing unit, toner and carrier in the agitation region 42 are hardly agitated, and the charging amount of toner is very small. When steps 110 through 130 are performed in this case, the amount of toner supplied to a developing region is very small, and thus, the concentration of a printed image may be lowered. Thus, preferably, before step 110, agitation is performed in step 160 for a predetermined amount of time so that the toner has a predetermined charging amount. An agitation time in this case may also be determined through experiments.

In addition, the method of controlling a toner charging amount according to an embodiment of the present invention may further comprise a step of counting the agitation time Ta and checking whether the new toner is supplied before the agitation time Ta reaches the reference agitation time Tr (step 170). Whether the new toner is supplied may be checked, for example, by detecting whether the toner supplying motor for continuously supplying toner to the agitation region 42 is being driven.

When the method of controlling the amount of toner charging further comprises the step of controlling the toner concentration (step 200), if the concentration, that is, the weight ratio of toner in the agitation region 42 is less than the reference weight ratio Wt regardless of the agitation time Ta, the new toner is supplied to the agitation region 42. In this case, the toner is not overcharged, and counting the agitation time Ta stops, and the agitation time Ta is reset. In this case, the step of controlling the toner concentration (step 200) is performed.

Figure 4:
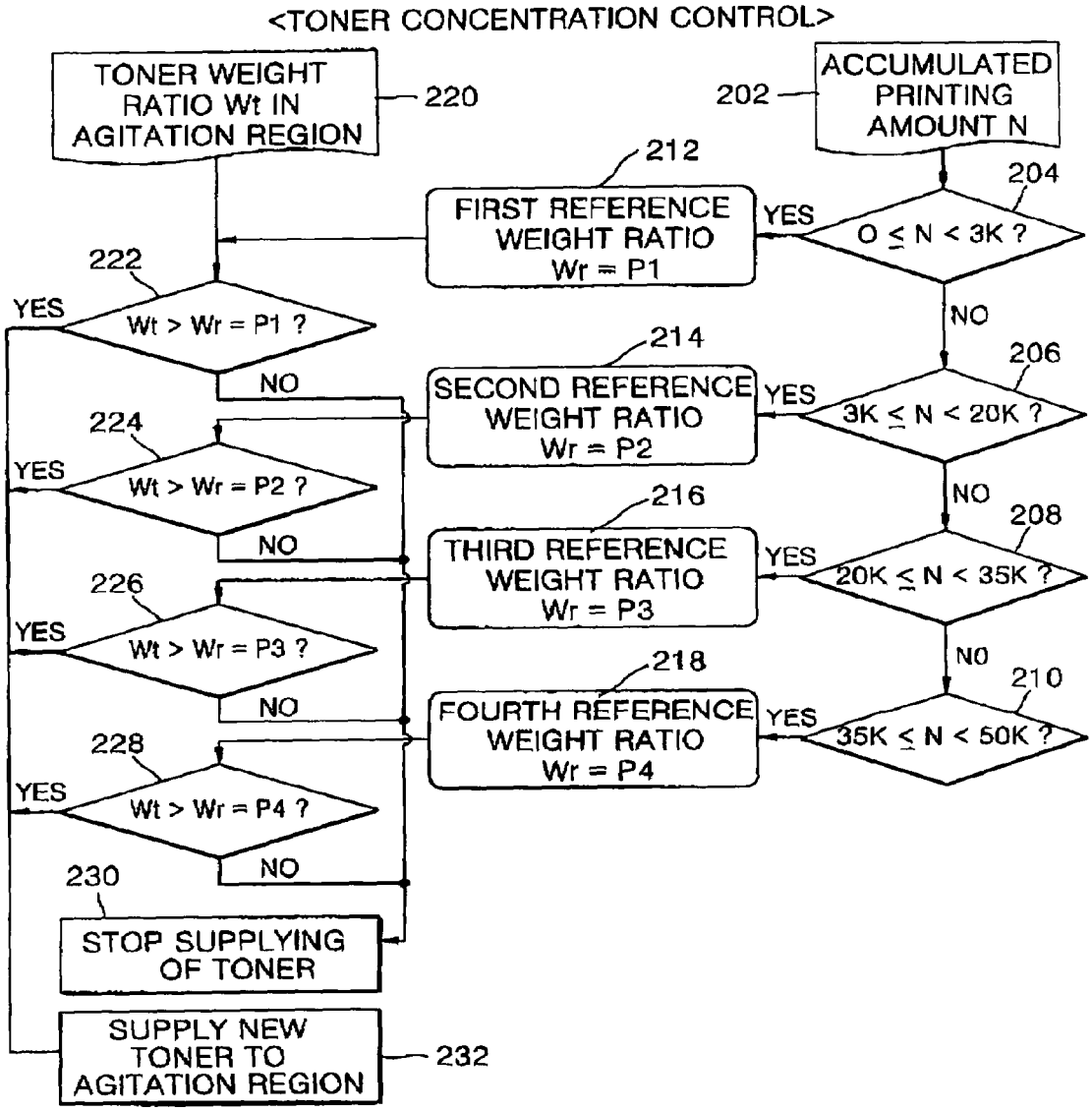
FIG. 4 is a flowchart illustrating the step of controlling toner concentration shown in FIG. 3 according to an embodiment of the present invention.

FIG. 4 is a flowchart illustrating the step of controlling the toner concentration shown in FIG. 3 according to an embodiment of the present invention. Referring to FIG. 4, the accumulated printing amount N of the developing unit 40 is set in four steps. First through fourth reference weight ratios Wr (=P1, P2, P3, and P4) for each step are set separately in steps 212, 214, 216 and 218. In the present embodiment of the invention, when the accumulated printing amount N from step 202 is $0 \leqq N < 3K$, $3K \leqq N < 20K$, $20K \leqq N < 35K$, and $35K \leqq N < 50K$, in steps 204, 206, 208 and 210 respectively, the first through fourth reference weight ratios Wr (=P1, P2, P3, and P4) are set separately in steps 212, 214, 216 and 218. Preferably, the first through fourth reference weight ratios Wr (=P1, P2, P3, and P4) are set to $P1<P2<P3<P4$ in steps 212, 214, 216, and 218. This indicates that toner concentration is controlled so that as the accumulated printing amount N increases, the amount of toner in the agitation region 42 becomes larger. The carrier is not developed and is continuously used in the developing unit. Thus, if the accumulated printing amount N is increased, the performance of the carrier deteriorates, and the property of attaching the toner to the carrier is lowered. Thus, in consideration of the deteriorated performance of the carrier, if the accumulated printing amount is increased, the amount of toner in the agitation region 42 is increased.

Preferably, a possibility of attaching the toner to the carrier is increased, and the deterioration of the performance of the carrier due to an increase in the accumulated printing amount N is offset by stopping the supply of toner in step 230.

The weight ratio Wt of toner in the agitation region 42 in step 220 is compared with the first through fourth reference weight ratios Wr (=P1, P2, P3, and P4) in steps 222, 224, 226 and 228 according to the accumulated printing amount N. When the toner weight ratio Wt is smaller than the first through fourth reference weight ratios Wr (=P1, P2, P3, and P4), the toner supplying motor is driven, and toner is supplied to the agitation region 42 in step 232. Since during the above process, new toner is supplied to the agitation region 42 in step 232 and there is little possibility that the toner is overcharged, the steps of controlling the amount of toner charging (in steps 110, 120, and 130 of FIG. 3) by counting the agitation time Ta are not performed.

The above-described image forming apparatus has been described as an example of a monochromatic image forming apparatus. However, the method of controlling a toner charging amount according to an embodiment of the present invention can also be used in a color image forming apparatus.

As described above, the method of controlling the amount of toner charging in the electrophotographic image forming apparatus according to an embodiment of the present invention has the following effects. First, it is determined whether new toner is supplied to an agitation region based on an agitation time of a developing agent, such that overcharing of the toner when an image having a low concentration when printed is prevented. In other words, the charging amount of toner in the agitation region can be maintained at a constant level regardless of printing conditions of the image forming apparatus, that is, a variation in concentration of a printed image. Second, the method further comprises the step of controlling the toner concentration, and the step of preventing overcharging of the toner is performed together with the step of controlling the toner concentration, such that toner concentration is maintained at a constant level. Third, the method further comprises the step of detecting whether a developing unit is a new developing unit, and if it is, the toner is agitated so that toner in the agitation region has a predetermined charging amount, thereby preventing lowering of concentration of a printed image.

While this invention has been particularly shown and described with reference to an embodiment thereof, it will be understood by those skilled in the art that various changes in form and details may be made therein without departing from the spirit and scope of the invention as defined by the appended claims.

What is claimed is:

1. A method of controlling an amount of toner charging in an electrophotographic image forming apparatus using a two-component developing agent, the method comprising:

(a) counting an agitation time when a toner and a carrier are mixed and agitated in an agitation region of a developing unit, and if the agitation time reaches a predetermined reference agitation time, supplying a predetermined amount of new toner to the agitation region to prevent overcharging of the toner.

2. The method of claim 1, further comprising:

(b) if the new toner is supplied to the agitation region before the agitation time reaches the reference agitation time, resetting the agitation time and counting the agitation time again.

3. The method of claim 2, wherein in step (b), whether new toner is supplied to the agitation region is detected by checking whether a toner supplying motor for supplying toner to the agitation region is being driven.

4. The method of claim 1, further comprising:

(c) if the electrophotographic image forming apparatus is turned on, checking whether the developing unit is a new developing unit, and if the developing unit is a new developing unit, not counting the agitation time and agitating the developing agent so that the toner in the agitation region has a predetermined charging amount.

5. The method of claim 4, wherein in step (c), whether the developing unit is the new developing unit is detected by checking an accumulated printing amount of the developing unit.

6. The method of claim 1, wherein a weight ratio of toner with respect to the developing agent in the agitation region is maintained to be within a predetermined percentage of a predetermined reference weight ratio.

7. The method of claim 6, wherein said predetermined percentage is 120%.

8. The method of claim 6, wherein the predetermined reference weight ratio is less than 10%.

9. The method of claim 6, wherein an accumulated printing amount of the developing unit is set, and the reference weight ratio is set based on said accumulated printing amount.

10. The method of claim 9, wherein if the accumulated printing amount is increased, the reference weight ratio is also increased.

11. The method of claim 1, further comprising (d) comparing a weight ratio of the toner with respect to the developing agent in the agitation region with a predetermined reference weight ratio, and if the weight ratio of the toner is less than the reference weight ratio, supplying the toner to the agitation region, and if the weight ratio of the toner is not less than the reference weight ratio, stopping the supply of toner to the agitation region, and wherein if the weight ratio of the toner with respect to the developing agent in the agitation region after step (a) is performed is greater than 120% of the reference weight ratio, performing step (d).

12. An apparatus for controlling an amount of toner charging in an electrophotographic image forming apparatus using a two-component developing agent, the apparatus comprising:

a developing unit having an agitation region for counting an agitation time when a toner and a carrier are mixed and agitated, and if the agitation time reaches a predetermined reference agitation time, supplying a predetermined amount of new toner to the agitation region to prevent overcharging of the toner.

13. The apparatus of claim 12, wherein if the new toner is supplied to the agitation region before the agitation time reaches the reference agitation time, the agitation time is reset and counted again.

14. The apparatus of claim 12, wherein if the electrophotographic image forming apparatus is turned on, checking whether the developing unit is a new developing unit, and if the developing unit is a new developing unit, not counting the agitation time and agitating the developing agent so that the toner in the agitation region has a predetermined charging amount.

15. The apparatus of claim 12, wherein a weight ratio of toner with respect to the developing agent in the agitation region is maintained to be within a predetermined percentage of a predetermined reference weight ratio.

16. The apparatus of claim 15, wherein said predetermined percentage is 120%.

17. The apparatus of claim 15, wherein the predetermined reference weight ratio is less than 10%.

18. The apparatus of claim 15, wherein the accumulated printing amount of the developing unit is set, and the reference weight ratio is set based on said accumulated printing amount.

19. The method of claim 15, wherein if the accumulated printing amount is increased, the reference weight ratio is also increased.

20. The apparatus of claim 12, wherein the developing unit compares a weight ratio of the toner with respect to the developing agent in the agitation region with a predetermined reference weight ratio, and if the weight ratio of the toner is less than the reference weight ratio, supplies the toner to the agitation region, and if the weight ratio of the toner is not less than the reference weight ratio, stops the supply of toner to the agitation region, and wherein if the weight ratio of the toner with respect to the developing agent in the agitation region after the counting is performed is greater than 120% of the reference weight ratio, the developing unit compares the weight ratio of the toner with respect to the developing agent in the agitation region with the predetermined reference weight ratio.

* * * * *